US005112059A

United States Patent [19]

Mundle et al.

[11] Patent Number: 5,112,059

[45] Date of Patent: May 12, 1992

[54] CARD GAME

[76] Inventors: Craig M. Mundle, 555 Huntercreek Ridge Ct., Des Peres; David D. Jahnke, 1639 Mason Knoll Rd., Town and Country, both of Mo. 63131; Michael T. Rickert, 155 N. Hanley, Unit 202, University City, Mo. 63105; William N. Robertson, 14120 Westernmill, Chesterfield, Mo. 63017

[21] Appl. No.: 689,143

[22] Filed: Apr. 22, 1991

[51] Int. Cl.[5] ..... A63F 1/00

[52] U.S. Cl. ..... 273/292; 273/303; 273/306; 273/308

[58] Field of Search ..... 272/292, 303-306, 272/308

[56] References Cited

U.S. PATENT DOCUMENTS

| | | | |
|---|---|---|---|
| D. 135,716 | 5/1943 | Willard | 273/292 |
| D. 269,921 | 8/1983 | Young et al. | 273/292 |
| 786,022 | 3/1905 | Gee et al. | 273/292 |
| 1,048,346 | 12/1912 | Ritzman | 273/306 |
| 2,072,799 | 3/1937 | Creswell | 273/292 |
| 2,296,904 | 9/1942 | Brown et al. | 273/292 |
| 4,071,247 | 1/1978 | Breslow | 273/292 |
| 4,243,226 | 1/1981 | Kendall | 273/292 |
| 4,369,976 | 1/1983 | Chunn | 273/292 |

OTHER PUBLICATIONS

Hoyle's Simplified Guide to the Popular Card Games by Walter Gibson, Doubleday & Company, Inc., 1963, pp. X and 87-93.

*Primary Examiner*—Benjamin Layno

*Attorney, Agent, or Firm*—Haverstock, Garrett and Roberts

[57] ABSTRACT

A method and apparatus for playing a card game containing a deck of sixty cards. The deck is divided into four distinguishable categories. Each category comprises a plurality of cards numbered consecutively. The deck also includes two non-numbered cards. A predetermined number of cards have point values. During game play tricks are played with each player playing a card having the same category as the category of the card leading the trick. After each player has had a turn at playing a card of the trick, the player that played the highest numbered card of the trick takes the trick along with the points, if any, in the trick. The player which took the last trick leads a card for the next trick. A player is forced to take a trick when that player plays a multiple point value card during a trick and an opposing player counters by playing a non-numbered card in the same trick. The object of the game is to avoid acquiring points.

8 Claims, 9 Drawing Sheets

CARD GAME

BACKGROUND OF THE INVENTION

This invention relates to a card game which may be played by two or more persons for amusement and education.

Card games have been played from the beginning of recorded history for the joy, amusement and education of people. Card games are used as gaming devices to the great joy and dismay of the participants. Card games include such well known card games as poker, hearts, fortune telling, pinochle, rummy and bridge. A card game called "hunting" is described in U.S. Pat. No. 2,072,799. A card game utilizing the American flag is described in U.S. Pat. No. 2,296,904. A card game relating to nation's generals is described in U.S. Pat. No. 4,071,247. Still another card game based on principal parts of speech in the English language is described in U.S. Pat. No. 4,369,976.

SUMMARY OF THE INVENTION

The card game of this invention is identified as "Scud Alert" and utilizes catagories relating broadly to military activities, including missiles, armored vehicles, jet aircraft and flags. "Patriot Missiles" are included. The Scud Alert card game includes sixty cards and may be played by at least two players and as many as ten or more players. The card game of this invention is generally played by individual participants but the game may be played by partners.

Each Scud Alert card game hand contains a total of 70 points. The points are associated with particular cards, the object of the game being to avoid acquiring point cards. The number "10" card in each catagory is a 10 point card although the card number and points may be optional. The number "16" missile card identified as the SCUD missile card, is shown to carry 16 points although the selected card and the number of points may be optional. Except for the SCUD missile card number 16 and the SCUD missile card number 10 all cards in the missile catagory carry 1 Point, although the catagory of cards and the number of points are optional. Either of two Patriot Missile cards may force a particular trick to a particular player. A game is won by the player with the least number of points when another player reaches 200 points, although this point total may be changed at the option of the players.

BRIEF OF DESCRIPTION OF THE DRAWINGS

FIGS. 1*a* and 1*b* hereinafter identified as shows the sixteen cards in the missiles category;

FIGS. 2*a* and 2*b* hereinafter identified as shows the fourteen cards in the armored vehicles category;

FIGS. 3*a* and 3*b* hereinafter identified as shows the fourteen cards in the jet aircraft category;

FIGS. 4*a* and 4*b* hereinafter identified as shows the fourteen cards in the flags category;

DETAILED DESCRIPTION OF PREFERRED EMBODIMENT

Figure 1A:
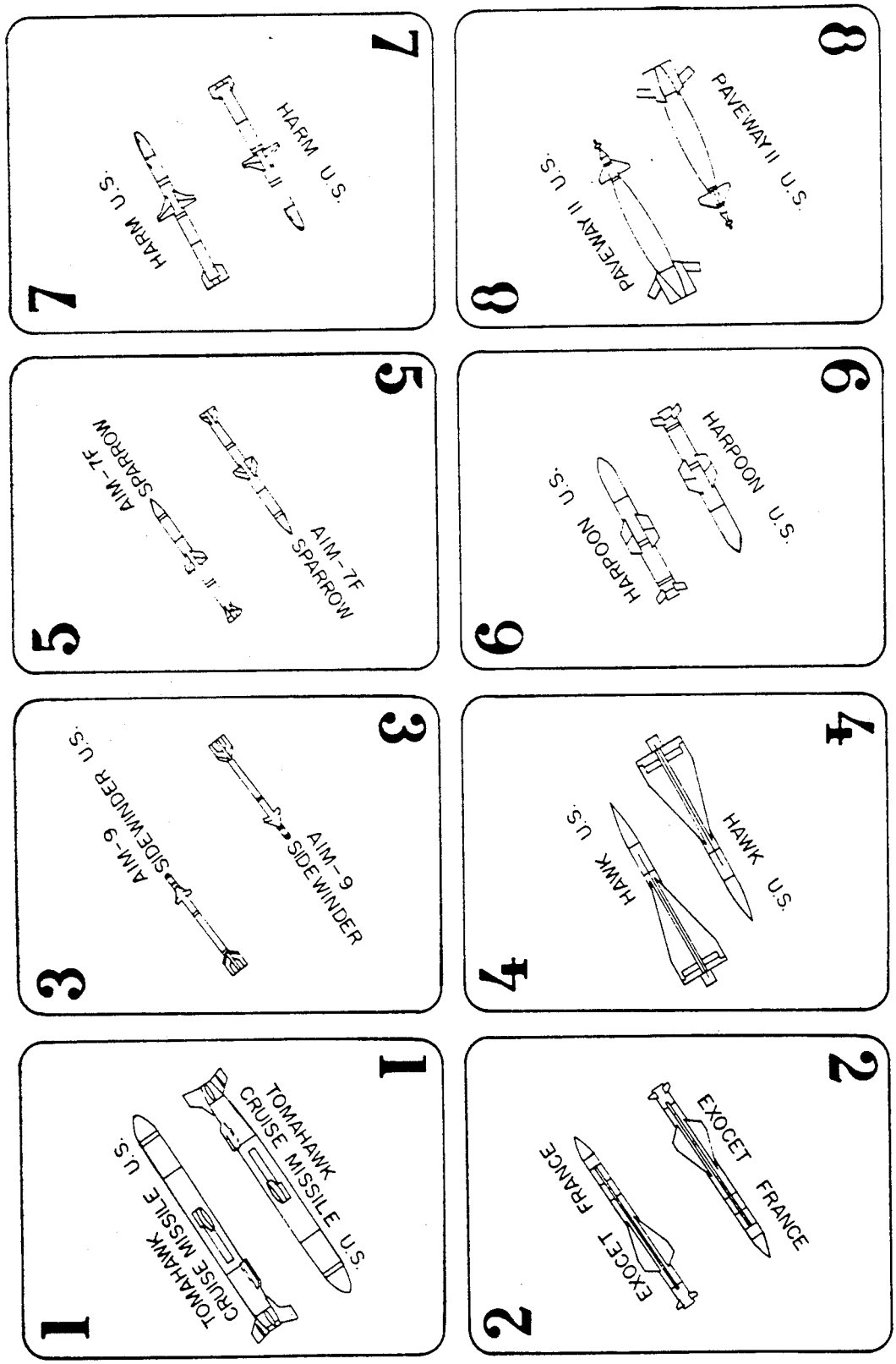
Figure 1B:
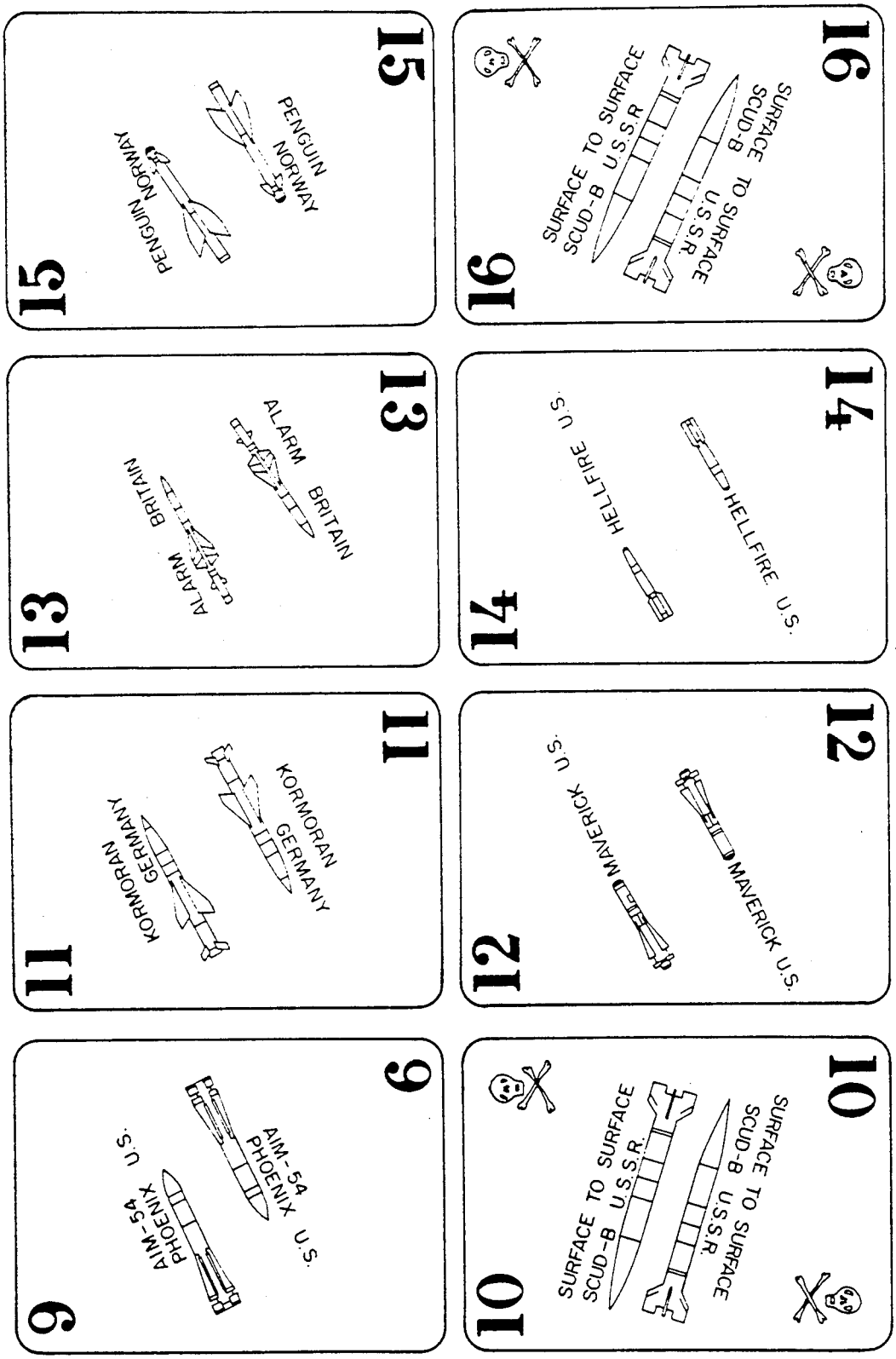

FIG. 1 missiles cards include cards identified as Tomahawk Cruise missiles, Exocet missiles, Sidewinder missiles, HAWK missiles, Sparrow missiles, Harpoon missiles, HARM missiles, Paveway II missiles, Phoenix missiles, surface to surface Scud-B missiles, Kormoran missiles, Maverick missiles, Alarm missiles, Hellfire missiles, and Penguin missles.

Figure 2A:
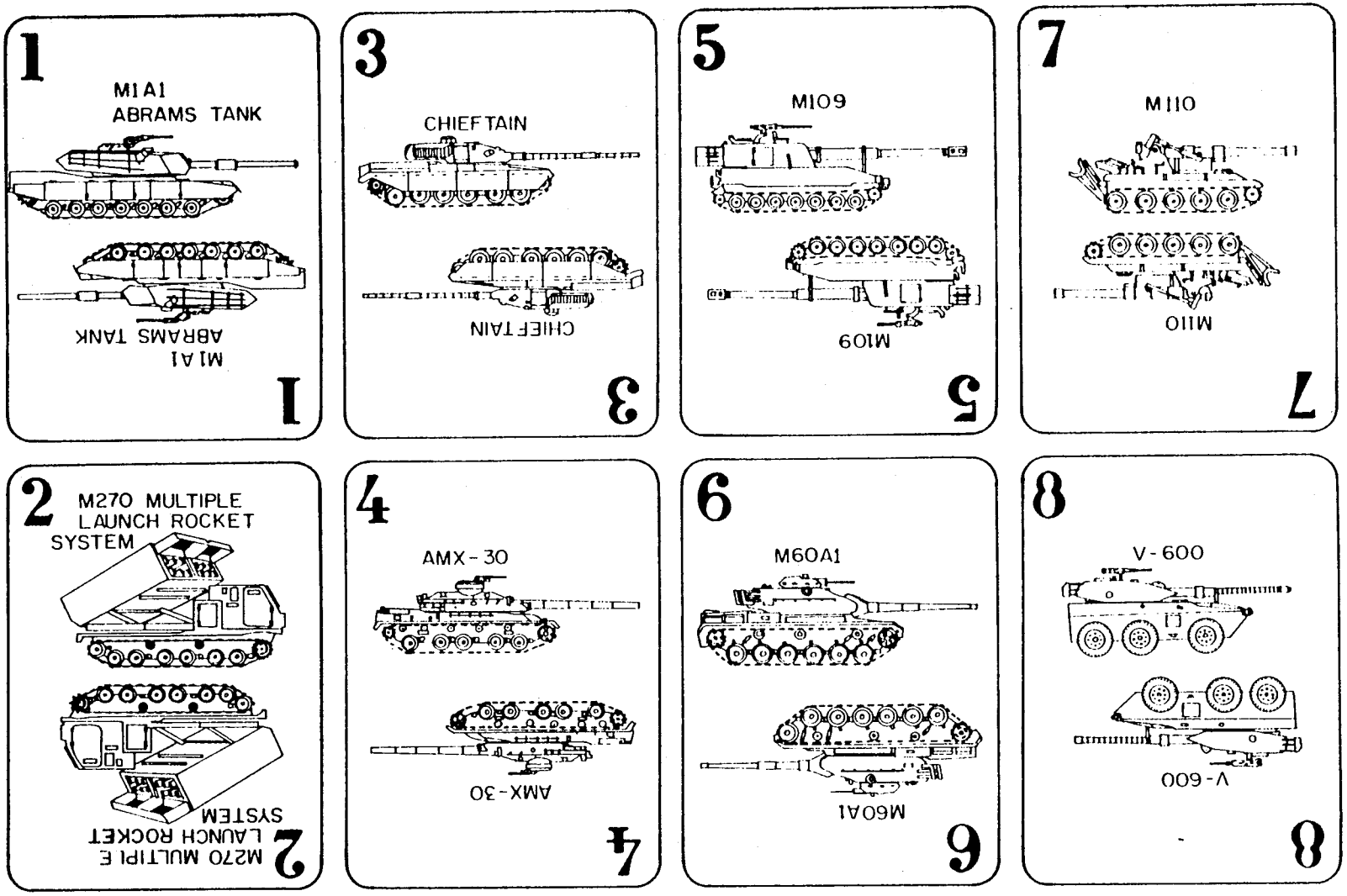
Figure 2B:
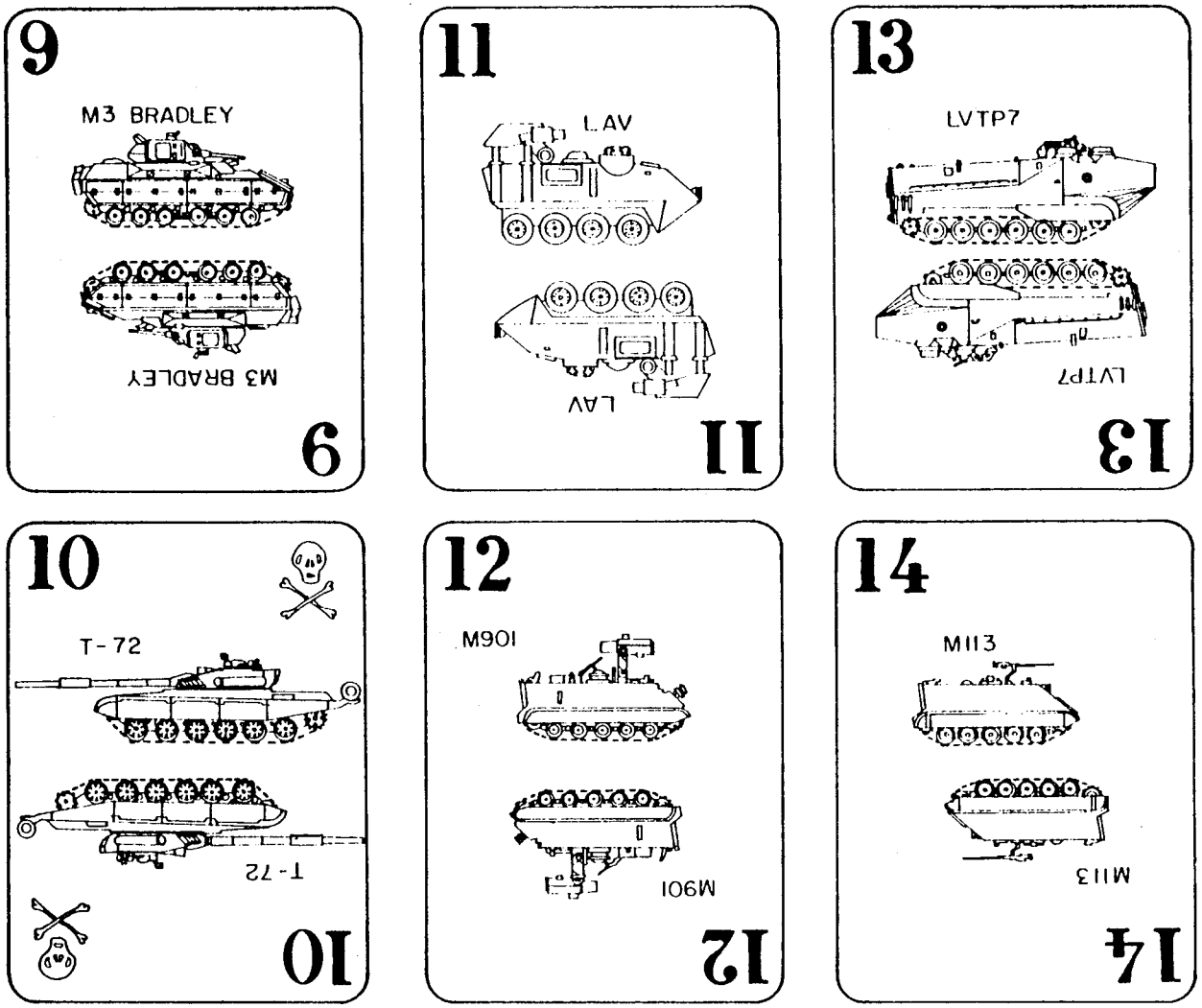

FIG. 2 catagory of cards includes armored vehicles such as tanks and other armored equipment identified as M1A1 Abrams tanks, M270 Mutiple Launch Rocket Systems, Chieftain tanks, AMX-30 tanks, M109 mobile units, M60A1 tanks, M110 vehicles, V-600 mobile units, M3 Bradley fighting vehicles, T-72 tanks, LAV vehicles, M901 mobile units, LVTP7 tanks and M113 tanks.

Figure 3A:
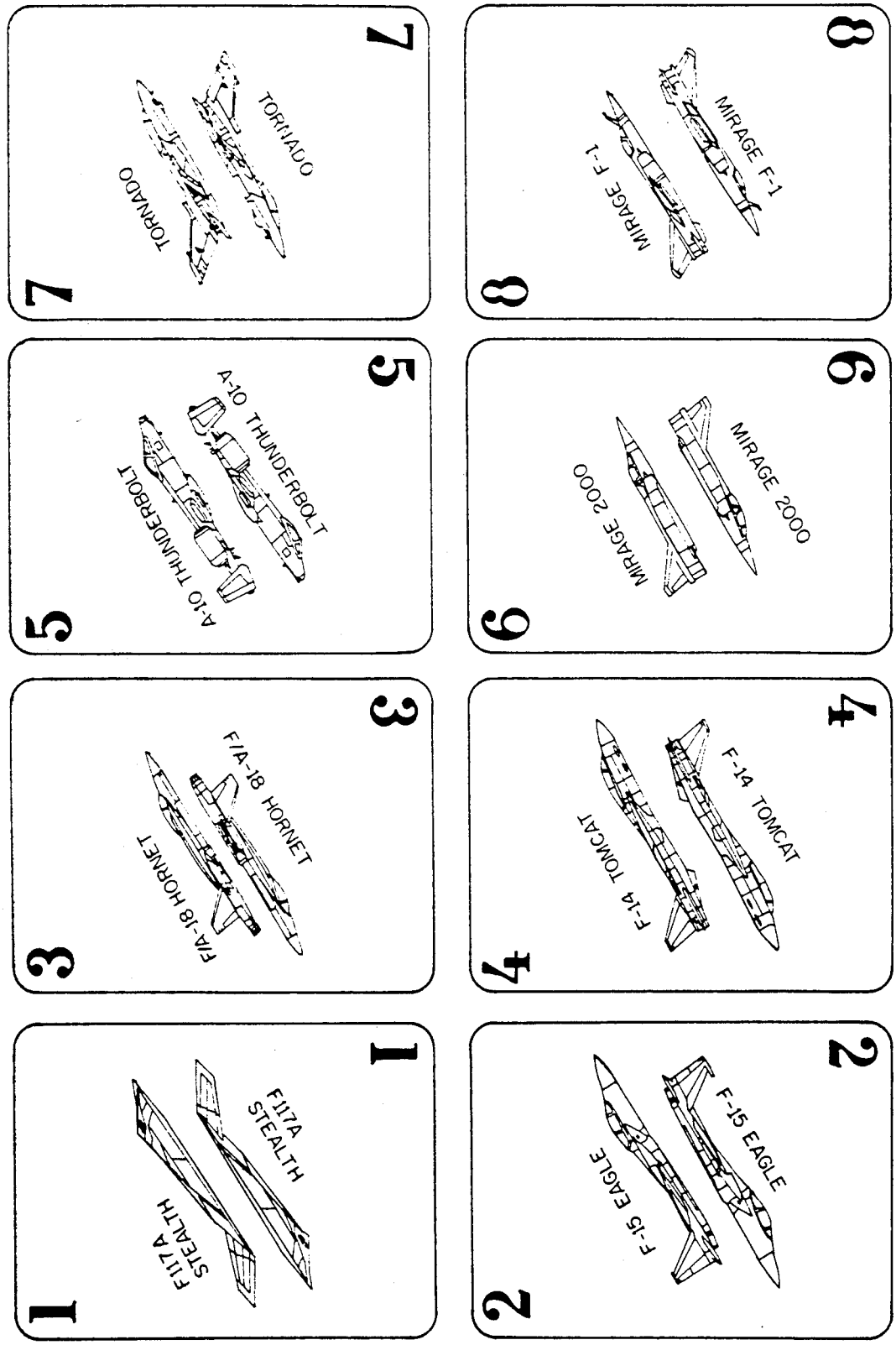
Figure 3B:
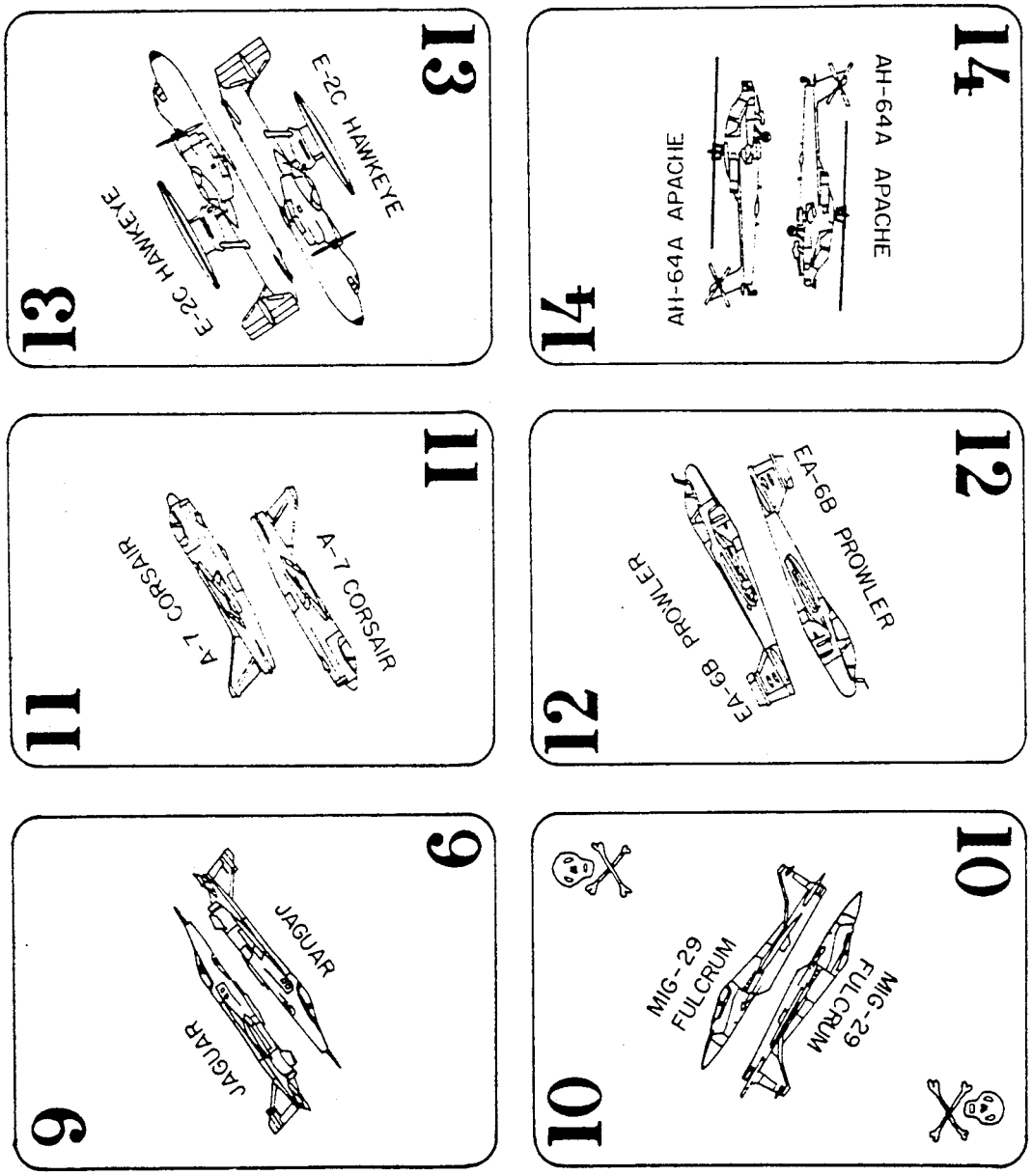

FIG. 3 jet aircraft catagory includes cards identified as F117A Stealth jet aircraft, F-15 Eagle jet aircraft, F/A-18 Hornet jet aircraft, F-14 Tomcat jet aircraft, A-10 Thunderbolt jet aircraft, Mirage 2000 jet aircraft, Tornado jet aircraft, Mirage F-1 jet aircraft, Jaguar jet aircraft, MiG-29 Fulcrum jet aircraft, A-7 Corsair jet aircraft, EA-6B Prowler jet aircraft, E-2C Hawkeye jet aircraft and AH-64A Apache jet aircraft.

Figure 4A:
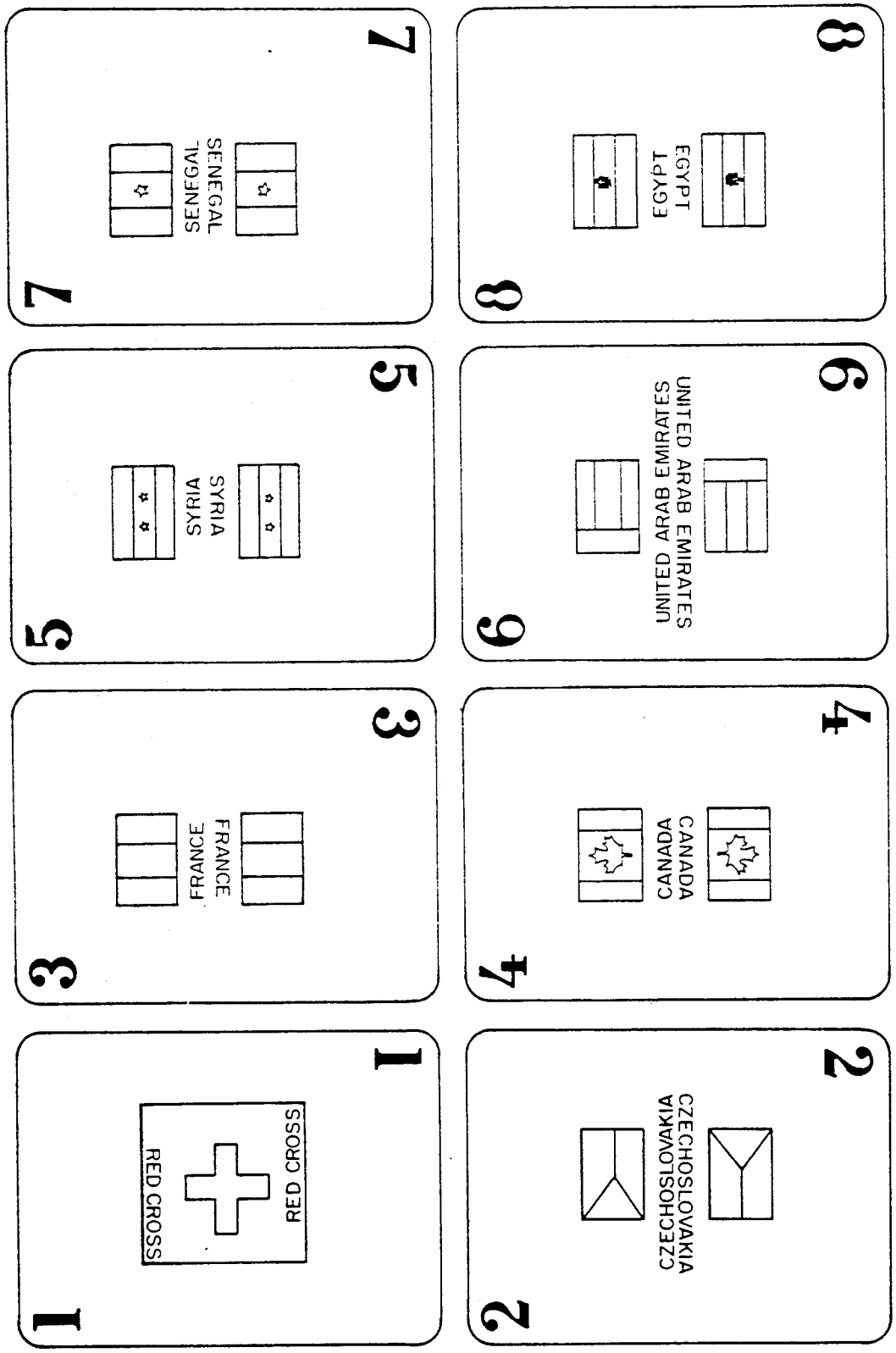
Figure 4B:
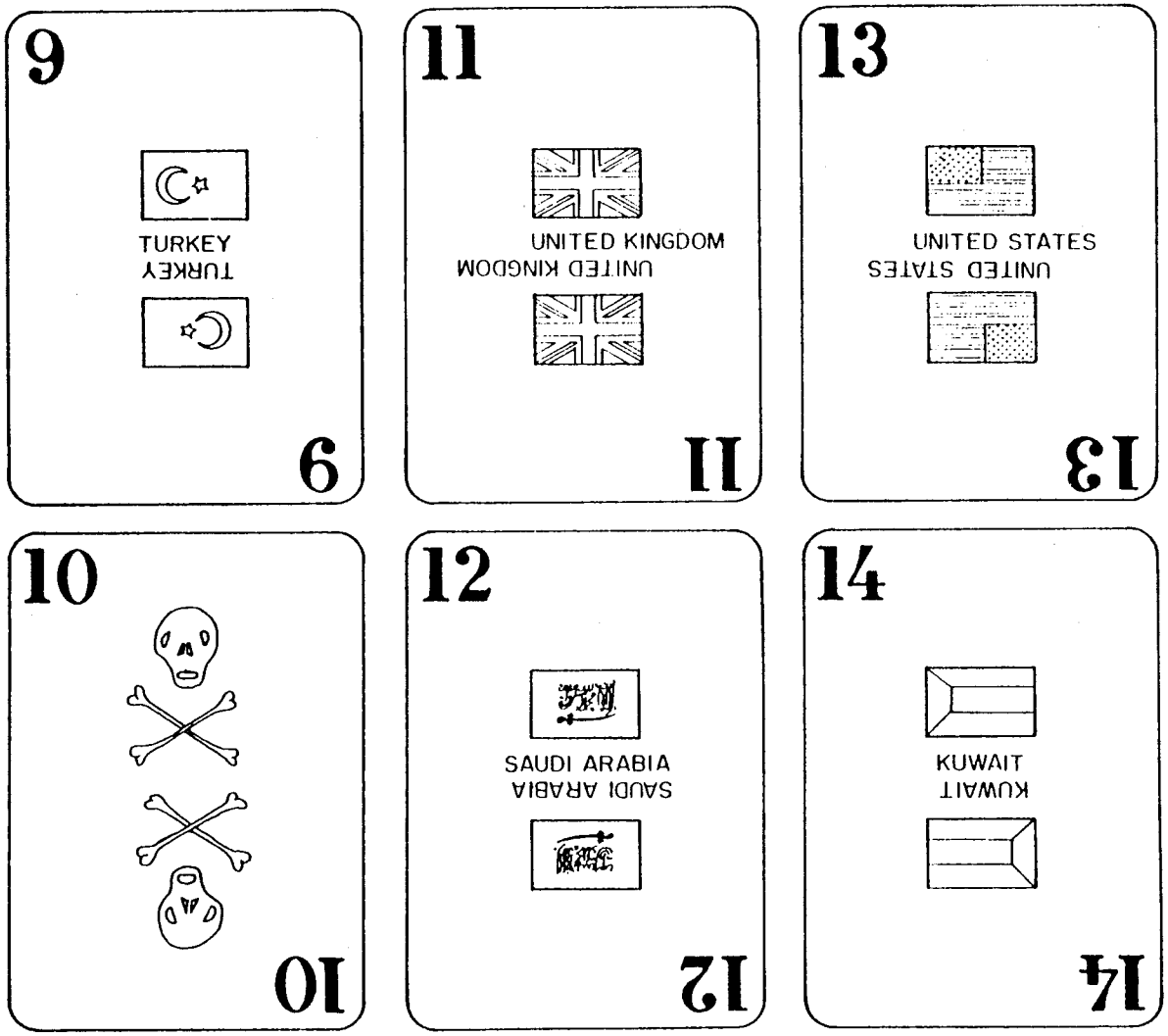

FIG. 4 flags catagory includes cards showing the Red Cross flag, the Czechoslovkia flag, the flag of France, the Canadian flag, the flag of Syria, the United Arab Emirates flag, the flag of Senegal, the Egyptian flag, the flag of Turkey, a skull and cross bones flag, the United Kingdom flag, the flag of Saudi Arabia, the United States flag and the flag of Kuwait.

Figure 5:
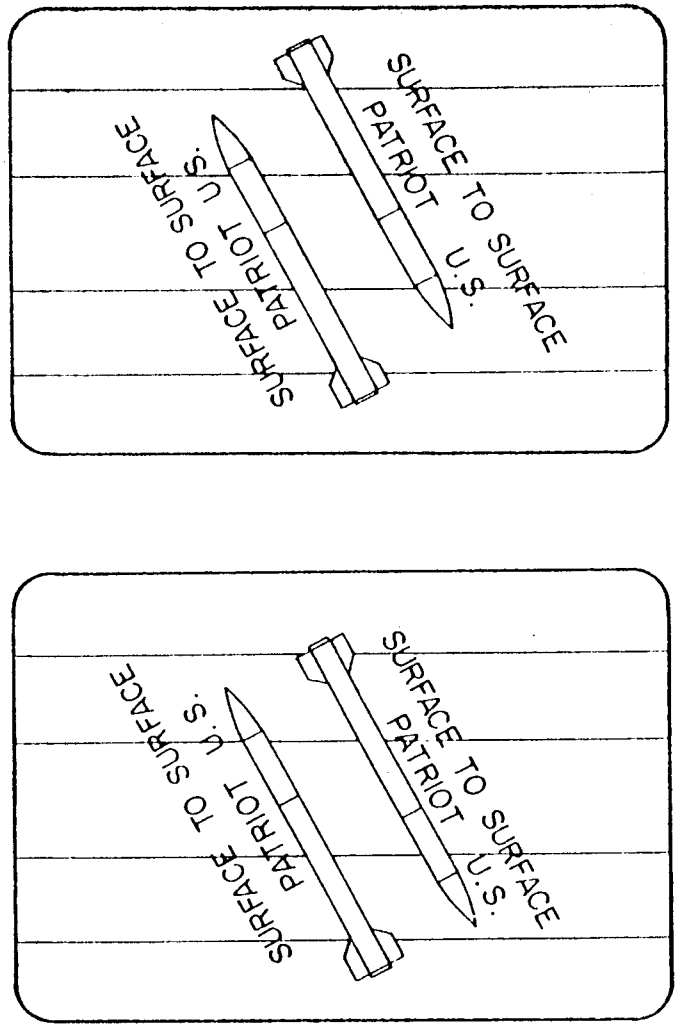
FIG. 5 shows the two cards identified as Patriot Missiles in the patriot missile category.

FIG. 5 patriot missile category shows the two surface to air Patriot Missile cards.

Figure 6:
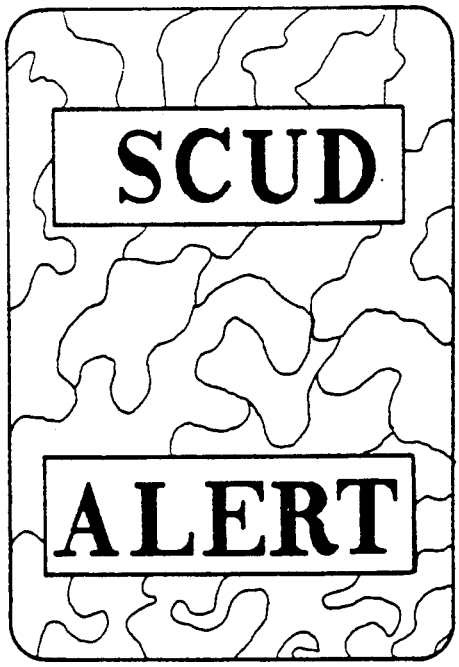
FIG. 6 shows the back of all cards.

FIG. 6 shows the SCUD ALERT card game trademark and design which appears on the back of all of the sixty cards in the deck.

The sixty cards in the deck have been identified in catagories, including missiles which are generally identified as yellow cards, armored vehicles which are generally identified as green cards, jet aircraft which are generally identified as blue cards and flags which are generally identified as pink cards. The Patriot Missile cards are generally shown with a red, white and blue background and the Scud Alert card game trademark is shown on a multicolored background which includes a camouflage pattern and wherein the trademark SCUD ALERT is shown in red on a yellow background. All military equipment cards are drawn in silhouette fashion with the equipment pointing from left to right when held upright except that all military equipment high point cards (the number 10 tank card, the number 10 jet card, the number 10 SCUD missile card and the number 16 SCUD missile card) are draw in silhouette fashion pointing from right to left and additionally identified with a skull and cross bone indicator to further highlight the signifiance of these cards to the player in possession of same. These various card designations and color combinations are indicated for illustrative purposes only and various other devices and color combinations may be used within the concept and scope of this invention.

METHOD OF PLAY

SCUD ALERT CARD GAME

A Game for Patriots

Directions

The standard SCUD ALERT card game deck has sixty (60) cards and five (5) categories a follows:

| Category | | |
|---|---|---|
| 1. | Missiles (Yellow) | 16 |

-continued

| Category | | |
|---|---|---|
| 2 | Armored Vehicles (Green) | 14 |
| 3 | Jet Aircraft (Blue) | 14 |
| 4 | Flags (Pink) | 14 |
| 5 | Patriot Missiles (Red, White, Blue) | 2 |
| | | 60 |

Cards will be dealt equally to each player at the start of each round in the following number:

| | |
|---|---|
| Two players | 30 cards |
| Three players | 20 cards |
| Four players | 15 cards |
| Five players | 12 cards |
| Six players | 10 cards |
| Eight players | 15 cards (combine two decks) |
| Ten players | 12 cards (combine two decks) |

Each hand will contain a total of seventy points determined as follows:

| | | |
|---|---|---|
| #10 Tank card (Green) | 10 points | 10 |
| #10 Jet Card (Blue) | 10 points | 10 |
| #10 Flag card (Pink) | 10 points | 10 |
| #10 SCUD Missile card (Yellow) | 10 points | 10 |
| #16 SCUD Missile card (Yellow) | 16 points | 16 |
| All Missile cards (Yellow | 1 point each | 14 |
| | | 70 |

The object of the game is to avoid point cards being charged to a player's account. This can be accomplished by avoiding tricks containing point cards.

The game is played as follows:

Select one player to deal the first hand. The deal rotates one player to the left after each hand.

The dealer shuffles the deals out all cards, one card at a time, face down.

Each player selects three unwanted cards from ones hand (based on foresight and strategy) and passes them to another player in the following sequence:

if 4 players — 1st hand, 1 player to left; 2nd hand, 1 player to the right; 3rd hand, player across; 4th hand, no cards are passed (Death Hand);

if 5 players — 1 player to left, 1 player to right, 2 players to left, 2 players to right, no cards are passed (Death Hand).

Same type sequence for fewer or additional players.

Each player must play the same category of card led unless the player is out of this category or plays the Patriot Missile card as noted below. If a player is out of cards in the category lead, any card may be played. Play starts by the player in possession of the #1 Red Cross Flag card, leading this card. The high card played of the category led takes the trick. The player taking the trick leads a card for the next trick.

The Patriot Missile cards are the only cards which may be played in lieu of following the category of the card led and they can never win a trick. The effect of playing a Patriot Missile card is as follows depending on the circumstance:

If a Patriot Missile card is played in any trick where another player plays an enemy SCUD Missile card, #10 card or #16 card, the Patriot card shoots down the SCUD missile card and forces the player who played the #10 card or #16 card to take that trick and all associated points, as well as it puts that person into the lead for the next trick. If both a #10 card and the #16 SCUD Missile card are played in trick with a Patriot Missile card, the player who played the #16 SCUD Missile card takes the trick.

A Patriot Missile card may also be played by a player to avoid having to play a card in the category lead and, in return, getting unwanted points.

If a Patriot Missile card is led, the player immediately to the left of the player who led it now has to establish the lead category for that trick.

After all cards have been played, each player must count the number of points in the tricks taken and report them to the score keeper. Each completed hand must reflect the allocation of 70 points between all players.

The player with the least number of points at the point in time when another player reaches 200 points wins the game. Obviously, this number may be changed before starting any game.

After having gained confidence in the strategy of avoiding points, the following game feature may be adopted. A player may avoid points by blitzing all point cards. Blitzing means to take tricks containing all 70 point cards in the same hand. If a player can show to the other players that all point cards were received in the tricks taken by that Player, 70 points are allocated to each of the other players.

A further feature which may be added to the game is to blitz all cards of any given category within the same hand while not allowing the player to whom you passed to blitz any category with that hand.

If a player can show to the other players that all cards in any given category were won in the tricks taken by that player, all points that player would have had charged to his/her account, instead are charged to the account of the player who passed to the player who blitzed the category.

Although this card game has been described herein as involving categories identified with a patriotic theme, the concept of this card game includes utilization of different types of identified categories which could be utilized within the description and number of cards and categories. For example, different makes and designs of automobiles could be used in identification of the various categories and particular card units within the particular categories and the game could be played with sixty cards, categories and numbering system as described herein. The card game of this invention could be also used with other identifications such as farm tractors, and other classes of definitions adapted to the rules of the card game of this invention.

Thus there has been shown and described novel means for a card game. The present invention fulfills all the objects and advantages set forth above. It will be apparent to those skilled in the art, however, that many changes, modifications, variations and other uses and applications for the subject invention are possible. All such changes, modifications, variations and other uses and applications which do not depart from the spirit and scope of the invention are deemed to be covered by the invention, which is limited only the claims which follow.

We claim:

1. The pack of playing cards consisting essentially of sixty cards divided into five categories wherein one category consisting essentially of sixteen cards numbered consecutively from one to sixteen, a second category consisting essentially of fourteen cards numbered consecutively from one to fourteen, a third category consisting essentially of fourteen cards numbered consecutively from one to fourteen, a fourth catagory consisting essentially of fourteen cards numbered consecutively from one to fourteen and a fifth category consisting essentially of two non-numbered cards.

2. The pack of playing cards according to claim 1 wherein said first category includes cards which display thereon particular missiles, said second category includes cards which display armored vehicles thereon, said third category includes cards which display jet aircraft thereon, said fourth category includes cards which display flags of certain nations, the Red Cross flag and the skull and crossbones flag thereon and said fifth category which includes two Patriot Missile cards.

3. The pack of playing cards according to claim 2 wherein said first category includes cards numbered 1-9 and 11-15 which count for one point, card 10 which counts for ten points and card 16 which counts for sixteen points;

wherein said second category includes cards 1-9 and 11-14 which are non-counting cards and card 10 which counts for ten points;

wherein said third category includes cards 1-9 and 11-14 which are non-counting cards and card 10 which counts for ten points; and, wherein said fourth category includes card 1-9 and 11-14 which are non-counting cards and card 10 which counts for ten points, for a total of 70 points.

4. The pack of playing cards according to claim 2 wherein a fifth catagory includes only two non-counting patriot missile cards.

5. The pack of playing cards according to claim 2 wherein the back of each card displays the SCUD ALERT trademark on a camouflage design.

6. A method of playing a card game comprising the steps of:

providing a deck of cards having a plurality of distinguishable categories wherein each category having a plurality of numbered cards, the cards in each category numbered consecutively in numerical order, each category beginning with a common numeral;

providing at least one non-numbered card to said deck;

assigning a single point value to each card in only one said categories, and assigning a multiple point value to at least one card in each of said categories, wherein the remaining numbered cards having no point value;

dealing the entire deck of cards equally to each of at least two players;

designating a particular card to be the starting card, and a player having said designated card, playing said designated card to lead a first trick, each player in rotation playing a card of the same category led, at the end of one rotation, the player that played the highest numbered card taking the trick and acquiring the points in that trick, if any;

the player taking the trick leading a card for the next trick;

forcing a player to take a trick when said player plays a multiple point value card in said trick and an opposing player countering by playing a non-numbered card in said trick;

repeating the playing of tricks until a player reaches or exceeds a predetermined number of points, the player with the least number of points at the point of time wins the game.

7. A method of playing a card game according to claim 6 wherein one of said players may blitz said game by taking all points in all hands whereby all other players will be charged with the total number of points in the hand of the blitzing player.

8. A method of playing a card game according to claim 6 wherein one of said players may blitz said game by taking all cards within a given category whereby the player who passed to said blitzing player will receive the total number of points in the hand of the blitzing player.

* * * * *

UNITED STATES PATENT AND TRADEMARK OFFICE

CERTIFICATE OF CORRECTION

PATENT NO. : 5,112,059

DATED : May 12, 1992

INVENTOR(S) : Craig M. Mundle, David D. Jahnke, Michael T. Rickert and William N. Robertson It is certified that error appears in the above—identified patent and that said Letters Patent is hereby corrected as shown below:

Column 1, line 42, "Point" should be --point--.

Column 3, line 29, "(Yellow" should be --(yellow)--.

Column 3, line 37, the second "the" should be --and--.

Column 4, line 26, "Player" should be --player--.

Signed and Sealed this

Sixth Day of July, 1993

*Attest:*

Michael K. Kirk

MICHAEL K. KIRK

*Attesting Officer*

*Acting Commissioner of Patents and Trademarks*